United States Patent [19]

Uemura et al.

[11] Patent Number: 4,681,357

[45] Date of Patent: Jul. 21, 1987

[54] AUTOMOTIVE DOOR HANDLE CONTAINER

[75] Inventors: Isamu Uemura, Yokosuka; Kazumasa Yamamoto, Chofu, both of Japan

[73] Assignee: Kokusan Kinzoku Kogyo Kabushiki Kaisha, Tokyo, Japan

[21] Appl. No.: 677,534

[22] Filed: Dec. 3, 1984

[51] Int. Cl.[4] ..... E05B 5/00

[52] U.S. Cl. ..... 292/336.3; 16/124; 292/347; 292/DIG. 31; 292/DIG. 63

[58] Field of Search ..... 292/DIG. 31, 336.3, 292/347, DIG. 63, DIG. 13, 337; 70/208; 16/124

[56] References Cited

U.S. PATENT DOCUMENTS

| | | | |
|---|---|---|---|
| 2,668,076 | 2/1954 | Troche et al. | 292/DIG. 31 X |
| 3,153,553 | 10/1964 | Sandor . | |
| 3,508,778 | 4/1970 | Legge et al. | 292/DIG. 31 X |
| 3,544,148 | 12/1970 | Sandor | 292/336.3 |
| 3,698,215 | 10/1972 | Truhon | 292/DIG. 31 X |
| 3,758,140 | 9/1973 | Prete, Jr. | 292/DIG. 31 X |
| 3,797,870 | 3/1974 | Beckman . | |
| 3,967,844 | 7/1976 | Torii et al. . | |
| 4,038,718 | 8/1977 | Reilhac et al. | 292/336.3 X |
| 4,116,027 | 9/1978 | Tannery . | |
| 4,270,668 | 6/1981 | Berfield . | |
| 4,309,884 | 1/1982 | Davis | 292/DIG. 31 X |
| 4,502,715 | 3/1985 | Lundblade . | |

FOREIGN PATENT DOCUMENTS

| | | | |
|---|---|---|---|
| 497292 | 12/1950 | Belgium | 292/DIG. 31 |
| 0147128 | 7/1985 | European Pat. Off. | 292/336.3 |
| 187646 | 11/1936 | Switzerland . | |
| 286804 | 11/1952 | Switzerland . | |
| 373433 | 5/1932 | United Kingdom . | |
| 887155 | 1/1962 | United Kingdom | 70/208 |

*Primary Examiner*—Robert L. Wolfe
*Assistant Examiner*—Lloyd A. Gall
*Attorney, Agent, or Firm*—Fleit, Jacobson, Cohn & Price

[57] ABSTRACT

An automotive door handle container which is formed by and on an escutcheon fixedly attached to a door panel, for normally containing a pivotable handle piece. The escutcheon is formed at a slightly lower level than the inside edge of the handle piece for covering a small idle gap between the handle piece and the escutcheon to prevent harmful physical damage to the operator's finger nail otherwise occurring during manual handling of the handle piece.

1 Claim, 3 Drawing Figures

AUTOMOTIVE DOOR HANDLE CONTAINER

BACKGROUND OF THE INVENTION

This invention relates to improvements in and to the automotive door handle container.

Conventional automotive doors are operated to open and close by manipulating a door handle. When the handle is turningly raised by the operator's hand towards him, so as to partially emerge from inside of a container casing, the door lock is brought into its unlock position ready for opening the door. In continuation of the said raising operation, the raised door handle is pulled manually towards him, and the door is pivotingly opened.

Upon opening of the door, the operator's hand is released from the door handle, then the latter is automatically returned under the action of a return spring back to within the container casing.

It has been experienced, however, that the operator's finger nail may frequently be squeezed in a small idle gap existing between the inside edge of the handle proper and the inside wall surface of the handle case, normally housing the latter, hereinafter briefly to be called "escutcheon", or the corresponding part of the door panel, thereby giving rise to grave hurt or damage to the finger's end.

SUMMARY OF THE INVENTION

It is, therefore, an object of the present invention to provide an improved automotive door handle unit capable of effectively preventing the physical hurt or damage onto the operator's finger's end during door-opening manipulation.

According to this invention, the escutcheon or the correspondingly shaped door panel per se is formed with an outwardly extending bent-outward projection situated at a slightly lower level than the inside edge of the pivotable handle piece, and indeed, for the purpose of intentionally preventing otherwise possible physical hurt or damage to operator's finger nail by careless invasion thereof into the said small idle gap existing between the inside edge of the handle piece and the correspondingly opposite part of the escutcheon or the door panel per se.

This and further objects, features and merits of the present invention will appear from the detailed description of preferred embodiments of the invention to be set forth hereinafter with reference to the accompanying drawing(s), in which:

BRIEF DESCRIPTION OF THE DRAWING(S)

DETAILED DESCRIPTION OF PREFERRED EMBODIMENTS

Referring now to the accompanying drawing, preferred embodiments of the invention will be described in comparison with a comparative conventional automotive door handle assembly.

Figure 1:
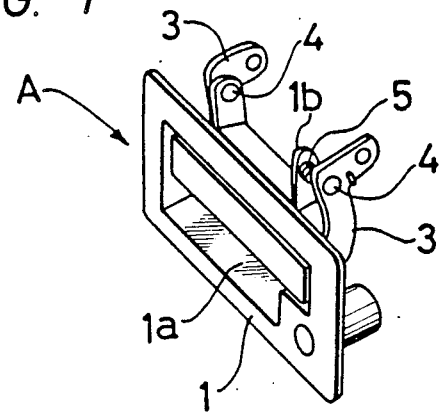
FIG. 1 is a schematic perspective view of the door handle unit of the present invention.

In FIG. 1, numeral 1 represents an escutcheon attached to an automotive door panel 7 which is shown only partially. As conventionally, the escutcheon 1 represents a recessed open space 1*a* opening towards the vehicle outside.

2 represents a handle piece which is normally contained substantially within the said open space 1*a*. A pair of arms 3 are made integral with the handle piece and pivotably connected at two places at 4 with a channel-shaped stationary mounting piece 1*b* which projects integrally from escutcheon 1. A return coil spring 5 is mounted on each of the pivot pins 4. When the operator has manually raised the handle piece 2 by applying a clockwise turning torque with his hand in FIG. 2 or 3 and then releases his hand therefrom, the handle piece will return automatically to the shown position under the spring action and thus within the holding space 1*a*.

Figure 2:
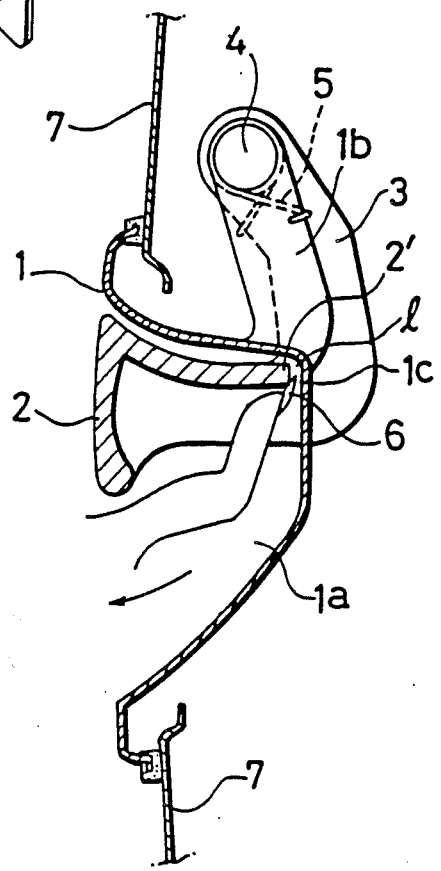
FIG. 2 is an enlarged cross-section of an essential part of the conventional door handle unit.
Figure 3:
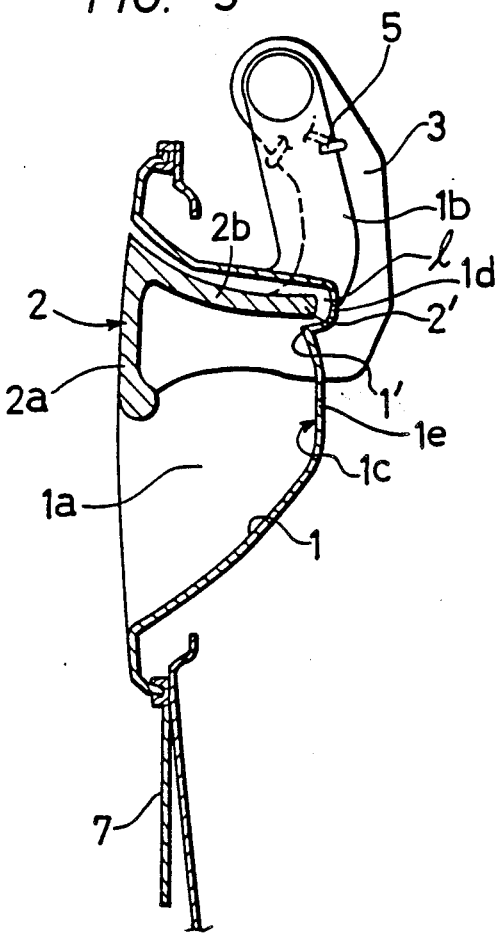
FIG. 3 is a similar cross-section of the inventively improved door handle unit of the present invention.

In the conventional arrangement shown in FIG. 2, there is a small idle gap l formed between the inside edge 2' of handle piece 2 and the inside wall surface 1*c* of escutcheon 1.

According to our experience, it has been found that an operator's finger nail as at 6 is sometimes subjected to squeezing between stationary wall surface 1*c* and moving handle edge 2' when manipulating the handle 2 for opening and closing the door, leading frequently to a physical injury.

For avoiding such defect, the escutcheon 1 is formed, in accordance with the present invention, with an outwardly projecting bent-forward projection 1' situated at a slightly lower level than the said inside edge 2' of handle piece 2, so as to enough cover the said idle gap l at a small distance therefrom.

Handle 2 includes ends 2*a* and 2*b* extending transverse to each other. Stationary wall surface 1*c* includes wall portion 1*d* and wall portion 1*e*. Wall portion 1*d* and wall portion 1*e* are separated by projection 1'. Wall portiion 1*d* extends further inwardly into recess 1*a* than wall portion 1*e* to define gap 1 between wall portion 1*d* and terminal inside edge 2' of handle 2. The terminal inside edge 2' is spaced from the outwardly projecting projection 1' and extends into recess 1*a* substantially the same distance as wall portion 1*e*. By adopting such provision as above, the finger nail as at 6 can be effectively prevented from occasional invasion into the said small idle gap l and thus, the desired safe guard against physical hurt or damage to the nail 6 or finger's end can effectively be assured.

Under certain occasion, the door panel 7 per se may be properly shaped so as to provide a handle-containing space substantially as at 1*a*. In such modified arrangement, the said projection 1' may be formed on the panel per se, and in place of the escutcheon, although not shown on account of easy occurrence to any skilled person in the art.

The embodiments of the invention in which an exclusive property or privilege is claimed are as follows:

1. A door handle assembly comprising:

door panel means, a handle recess defined by said door panel means, said handle recess including an outwardly projecting projection, a door handle pivotally mounted outside of said handle recess and said door handle being located in said handle recess and mounted on said door panel means for pivotable movement from said handle recess, said handle recess defining an open space for a hand of an operator to reach into said handle recess and pull outwardly on said door handle, said door handle including a first end flush mounted with an exterior surface of said door panel means and including a second end located opposite to said first end, said second end of said handle extending transverse to said first flush end, first and second bottom wall portions separated by said projection, said second bottom wall portion extending further inwardly into said handle recess than said first bottom wall portion to define a gap between itself and a terminal portion of said second end of said handle, said terminal portion being spaced from said outwardly projecting projection and extending into said handle recess substantially the same distance as said first bottom wall portion to thereby prevent the hand of the operator from being positioned between said second end and said door panel means when said door handle is in said handle recess in a position of rest.

* * * * *